US011011870B2

(12) United States Patent
Zhang et al.

(10) Patent No.: US 11,011,870 B2
(45) Date of Patent: May 18, 2021

(54) FIRST CONNECTOR, SECOND CONNECTOR AND ELECTRICAL CONNECTOR ASSEMBLY

(71) Applicant: Molex, LLC, Lisle, IL (US)

(72) Inventors: Teng Fei Zhang, Shanghai (CN); Feng Chen, Shanghai (CN); Hao Yin, Shanghai (CN)

(73) Assignee: Molex, LLC, Lisle, IL (US)

( * ) Notice: Subject to any disclaimer, the term of this patent is extended or adjusted under 35 U.S.C. 154(b) by 4 days.

(21) Appl. No.: 16/666,442

(22) Filed: Oct. 29, 2019

(65) Prior Publication Data

US 2020/0169034 A1 May 28, 2020

(30) Foreign Application Priority Data

Nov. 27, 2018 (CN) ..... 201811423564.0

(51) Int. Cl.
*H01R 13/62* (2006.01)
*H01R 13/639* (2006.01)

(52) U.S. Cl.
CPC ..... *H01R 13/6205* (2013.01); *H01R 13/639* (2013.01)

(58) Field of Classification Search
CPC ..... H01C 3/6205; H01C 3/639
See application file for complete search history.

(56) References Cited

U.S. PATENT DOCUMENTS 3,950,719 A * 4/1976 Maxwell ..... H01H 36/0073 335/205
9,729,791 B2 * 8/2017 Huerta ..... H01F 7/0252
9,806,458 B1 10/2017 Chiu et al.
(Continued)

FOREIGN PATENT DOCUMENTS

CN 2629189 Y 7/2004
CN 200997477 Y 12/2007
(Continued)

OTHER PUBLICATIONS

Decision to Grant received for JP application No. 2019-183432, dated Oct. 13, 2020, 5 pages. (2 pages of English translation and 3 pages of Official copy).

*Primary Examiner* — Abdullah A Riyami
*Assistant Examiner* — Nader J Alhawamdeh

(57) ABSTRACT

The present disclosure provides a first connector, a second connector and a connector assembly having the first connector and the second connector. The first connector comprises an insulating base, two first conductive members fixed on the insulating base, a first magnetic attraction ring sheathing the insulating base, and a switch assembly fixed in the insulating base. The second connector comprises an insulating body, two second conductive members fixed on the insulating body, a second magnetic attraction ring sheathing an outer circumference of the insulating body, and a cover further sheathing an outer circumference of the second magnetic attraction ring. The first connector and the second connector can achieve a function of 360 degree mating and charging. The first connector integrates charging function and switch function which can save one connector, save space and cost in a small electronic device, facilitates miniaturization of the electronic device.

10 Claims, 16 Drawing Sheets

(56) References Cited

U.S. PATENT DOCUMENTS

| | | | | |
|---|---|---|---|---|
| 9,985,384 | B1 * | 5/2018 | Johnson | H01R 24/86 |
| 10,454,208 | B2 * | 10/2019 | Johnson | H01R 13/6456 |
| 2010/0240230 | A1 | 9/2010 | Lee | |
| 2016/0127643 | A1 * | 5/2016 | Huerta | H04N 5/2253 348/211.2 |
| 2020/0076122 | A1 * | 3/2020 | Yin | H01R 13/17 |
| 2020/0169034 | A1 * | 5/2020 | Zhang | H01R 13/6205 |

FOREIGN PATENT DOCUMENTS

| | | | | |
|---|---|---|---|---|
| CN | 102187532 | A | 9/2011 | |
| CN | 203103652 | U | 7/2013 | |
| CN | 203760721 | U | 8/2014 | |
| CN | 105846245 | A | 8/2016 | |
| JP | H04-021072 | U | 2/1992 | |
| JP | 2002-093533 | A | 3/2002 | |
| JP | 2004-281179 | A | 10/2004 | |
| JP | 2004-342501 | A | 12/2004 | |
| JP | 2004342501 | A * | 12/2004 | H01R 13/7037 |
| JP | 2009-205912 | A | 9/2009 | |
| JP | 2012-142209 | A | 7/2012 | |
| WO | 2018/113780 | A1 | 6/2018 | |

* cited by examiner

FIRST CONNECTOR, SECOND CONNECTOR AND ELECTRICAL CONNECTOR ASSEMBLY

RELATED APPLICATION

This application claims priority to Chinese Application No. 201811423564.0, filed on Nov. 27, 2018, which application is incorporated herein by reference in its entirety.

TECHNICAL FIELD

The present disclosure relates to the field of electrical connector, particularly relates to a first connector, a second connector and an electrical connector assembly comprising the first connector and the second connector for facilitating miniaturization of an electronic device.

BACKGROUND ART

Chinese utility model patent CN203103652U discloses a magnetic attraction-type power connector, the magnetic attraction-type power connector comprises an outer housing, a PIN needle, a magnet and a colloid, both the interior structure and the exterior structure of the power connector are designed to be circular, and with the magnetic attraction-type structure, the connector as a header may be inserted by rotating 360 degrees around the circular center as an axis, so as to realize non-directional charge for the connector, a female connector and a male connector are attracted by the magnet, oppositely inserted in place and stably contact, the magnet adopt an assembling-type structure, and an anti-slide recessed groove is further designed on the magnet and cooperates with a convex groove of the colloid to fix the magnet with the colloid. The PIN needle of the power supply connector is used as a positive electrode, the concave semi-arc structure is adopted at the contact location of the PIN needle. The outer housing is used as the negative electrode, four elastic tabs are designed on the outer housing to contact and conduct with the male connector. The power connector is a connector header for mating with a car charger, has a single charging function, and cannot meet the needs of the industry to achieve diversified functions in one connector. Moreover, it is difficult to miniaturize due to the assembled and cooperated structures of the outer housing, the magnet and the colloid, which is not suitable for a small electronic device.

SUMMARY

The technical problem to be resolved by the present disclosure is to provide a first connector, a second connector and an electrical connector assembly which have a switch function, and facilitate miniaturization of an electronic device, so as to overcome the deficiency existing in the above prior art.

According to a solution of the present disclosure, the present disclosure provides a first connector comprising: an insulating base comprising a base portion and a mating portion protruding upwardly from the base portion, the mating portion has a receiving groove and a switch button which can move up and down along the receiving groove; a switch assembly provided in the insulating base and achieving switch function by up and down movement of the switch button; a first magnetic attraction ring sheathing an outer circumference of the mating portion, the mating portion extends upwardly beyond the first magnetic attraction ring; a plurality of first conductive members fixed on the insulating base, each first conductive member has a mating end and a tail, wherein the mating end of at least one first conductive member is exposed on an outer circumferential surface of the mating portion, and the tail extends downwardly out of the base portion.

According to another solution of the present disclosure, the present disclosure further provides a second connector comprising: an insulating body comprising a base and a protruding portion protruding upwardly from the base, an upper surface of the protruding portion is recessed with an accommodating groove; a second magnetic attraction ring sheathing an outer circumference of the protruding portion; a plurality of second conductive members fixed in the insulating body, each second conductive member comprises a contact end and a tip, the contact end is exposed in the accommodating groove, the tip protrudes downwardly from the base; a cover sheathing outer circumferences of the insulating body and the second magnetic attraction ring.

According to still another solution of the present disclosure, the present disclosure further provides an electrical connector assembly comprising the first connector as described above and the second connector as described above, wherein the mating portion of the first connector is correspondingly inserted into the accommodating groove of the second connector, the first magnetic attraction ring and the second magnetic attraction ring are magnetically attracted together to maintain electrical connection between the first conductive member and the second conductive member.

In comparison with the prior art, the present disclosure at least has the following advantages: the first connector of the present disclosure mounts a switch assembly in the insulating base and at the same time is equipped with a first conductive member, so the switch function and the charging function are integrated at the same time on the first connector. Two functions are integrated on one connector at the same time, when applied to a small electronic device, the connector can be used as a switch connector or a charging connector according to actual application situation, which can save one connector, save application space and cost in the small electronic device, and facilitates miniaturization of the electronic device. In the first connector, the mating end of at least one first conductive member is exposed and provided on the outer circumferential surface of the mating portion, which facilitates realization of the ability of mating and charging in 360 degrees between the first connector and the second charging connector, and is convenient to use. When the first connector is used as a charging connector, the first connector and the second connector maintain a reliable connection by magnetic attraction, which ensures the connection reliability during charging.

BRIEF DESCRIPTION OF DRAWINGS

FIG. 14 is a perspective view of FIG. 13 from another angle and further exploded.

DETAILED DESCRIPTION OF THE PREFERRED EMBODIMENTS

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features may be combined together to illustrate potential system designs, those features may also be used in other combinations not expressly described. Thus, the described combinations are not intended to be limiting, unless otherwise noted.

In the embodiments illustrated in the figures, representations of directions such as up, down, left, right, front and rear, used for explaining the structure and movement of the various components of the present disclosure, are not absolute, but relative. These representations are appropriate when the components are in the position shown in the figures. If the description of the position of the components changes, however, these representations are to be changed accordingly.

Hereinafter, preferred embodiments of the present disclosure are further described in detail in combination with the figures of the present disclosure.

Referring to FIG. 1 to FIG. 4, an electrical connector assembly 100 of the present embodiment comprises a first connector 1 and a second connector 2 which is matched with the first connector. The first connector 1 is preferably mounted to a device end, particularly suitable for small electronic devices such as Bluetooth headsets and the like. The second connector 2 is preferably mounted to a cable end and used in a charger. In use, the first connector 1 and the second connector 2 are cooperatively mated with each other, the second connector 2 transfers power of an exterior power supply to the first connector 1, thereby charging an electronic device mounted with the first connector 1.

For sake of convenient description, directions of ends of the first connector 1 and the second connector 2 which are mated with each other are defined as "up", directions away from the upper ends are "down".

Figure 1:
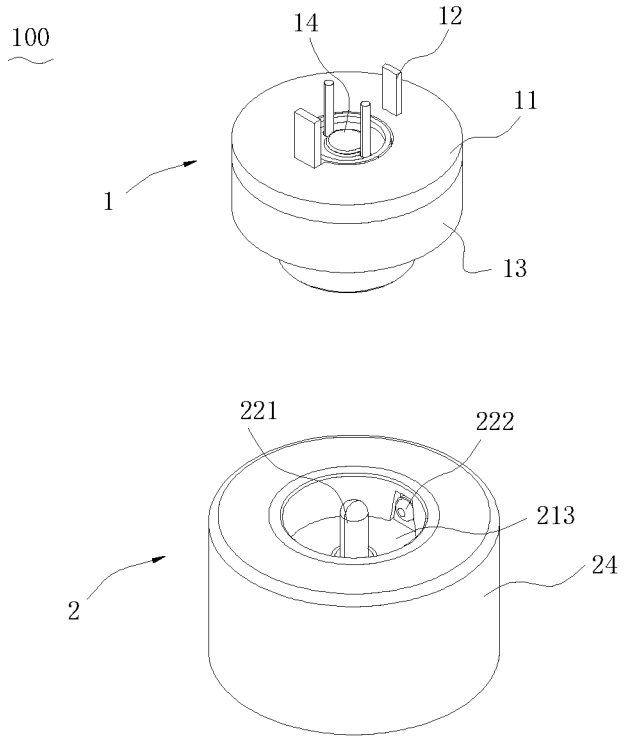
FIG. 1 is a perspective view of a first embodiment of an electrical connector assembly of the present disclosure.
Figure 2:
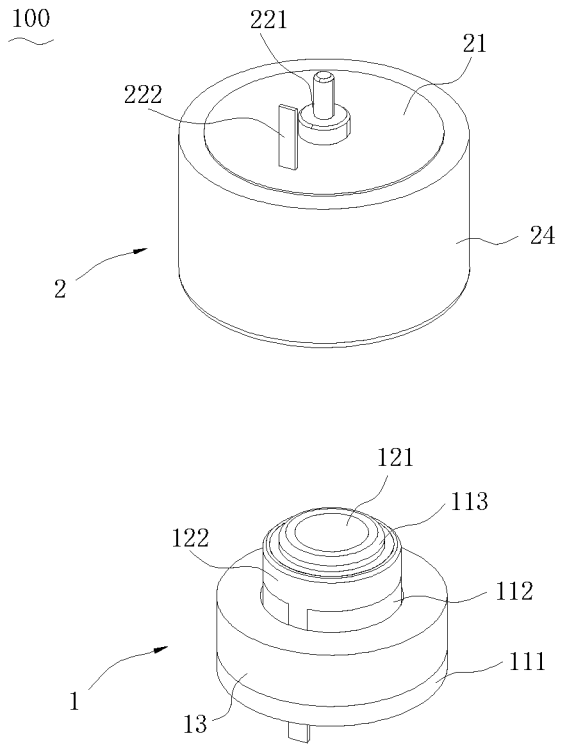
FIG. 2 is a perspective view of FIG. 1 from another angle.
Figure 3:
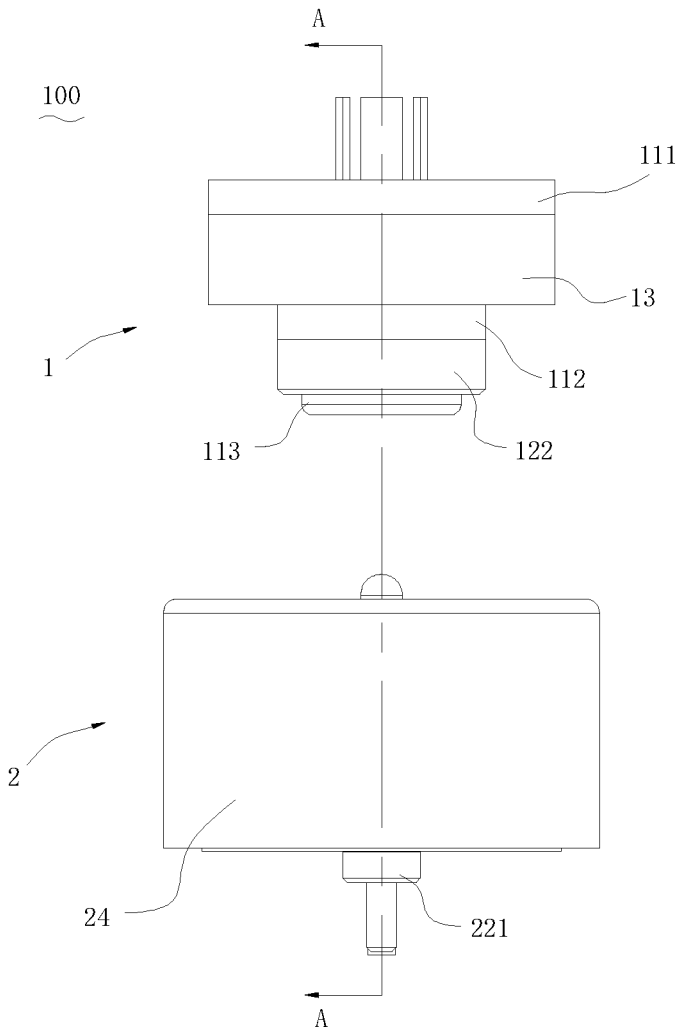
FIG. 3 is a front view of FIG. 1.
Figure 4:
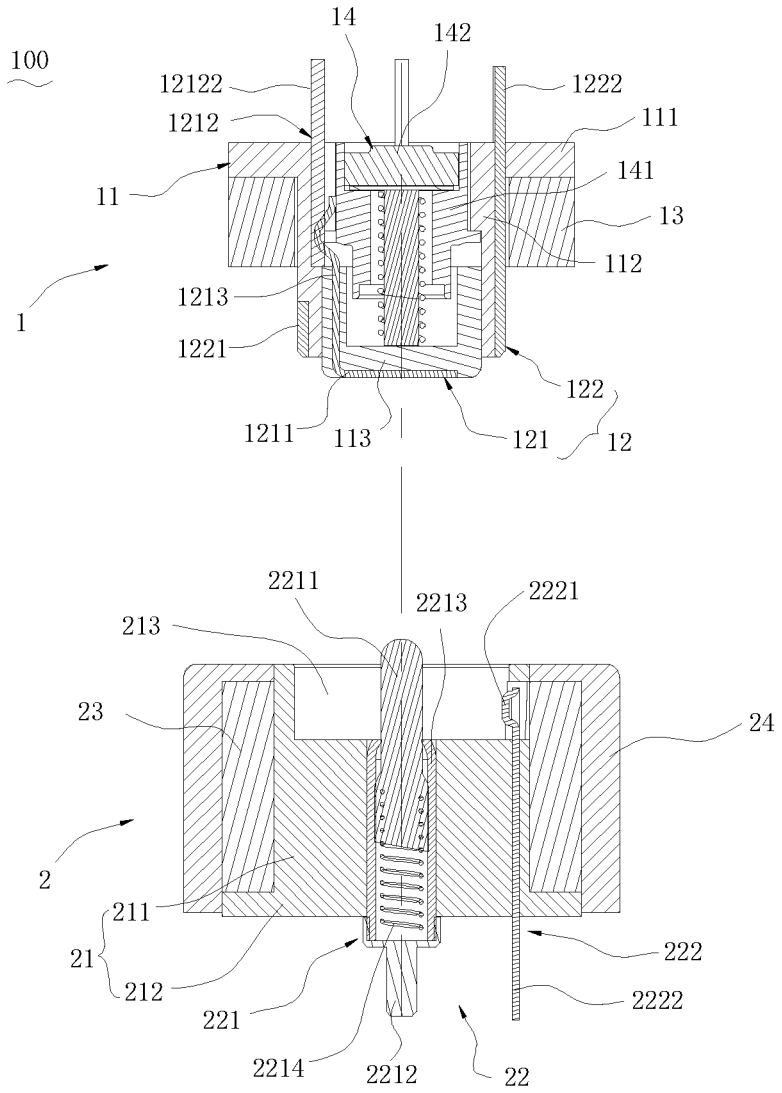
FIG. 4 is a cross sectional view along a line A-A of FIG. 3.
Figure 5:
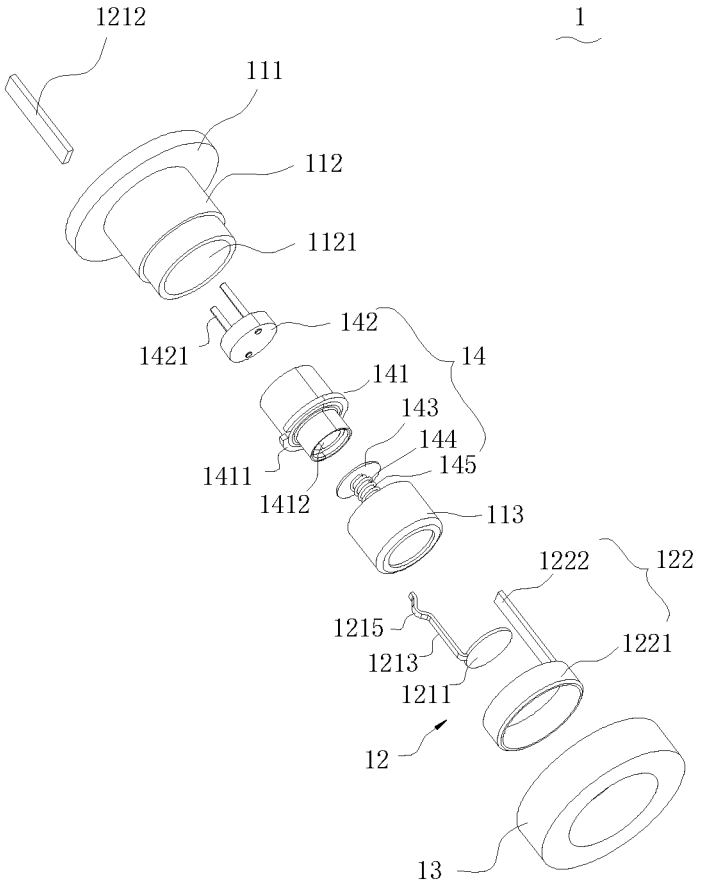
FIG. 5 and FIG. 6 are perspective exploded views of a first connector of FIG. 1 from two different angles.
Figure 6:
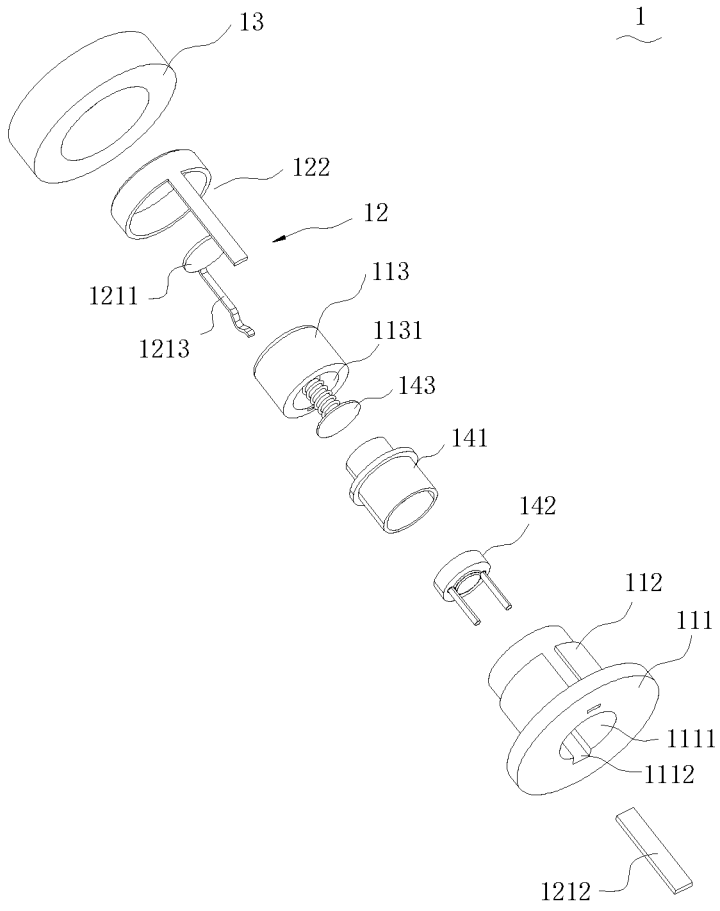

Referring to FIG. 4 to FIG. 6, the first connector 1 comprises an insulating base 11, two first conductive members 12 fixed to the insulating base 11, a first magnetic attraction ring 13 sheathing the insulating base 11 and a switch assembly 14 fixed in the insulating base 11.

The insulating base 11 comprises a base portion 111, a mating portion 112 protruding upwardly from the base portion 111 and a switch button 113 which can move up and down.

The base portion 111 and the mating portion 112 is preferably integrally formed, and becomes an integral structure by injecting molding an insulating plastic. Both the base portion 111 and the mating portion 112 are cylindrical and are coaxially. A radius of the base portion 111 is greater than a radius of the mating portion 112, which makes a contour of the insulating base 11 substantially configured as a stepped structure.

An upper surface of the mating portion 112 is recessed downwardly to form an upper receiving groove 1121. A lower surface of the base portion 111 is also recessed to form a lower receiving groove 1111. The upper receiving groove 1121 has a relatively large diameter, the lower receiving groove 1111 has a relatively small diameter, the upper receiving groove 1121 and the lower receiving groove 1111 are communicated in an up-down direction, a step surface is formed at a boundary between the upper receiving groove 1121 and the lower receiving groove 1111. The lower surface of the base portion 111 is preferably further provided with a guiding groove 1112. The guide groove 1112 is provided adjacent to the lower receiving groove 1111, and the guide groove 1112 and the lower receiving groove 1111 are communicated with each other. A depth of guiding groove 1112 is greater than a depth of the lower receiving groove 1111.

The switch button 113 is mounted in the upper receiving groove 1121 of the mating portion 112 and can move up and down along the upper receiving groove 1121. An outer circumferential surface of the switch button 113 and an inner wall of the upper receiving groove 1121 have a clearance fit therebetween, so that the switch button 113 can move up and down. The switch button 113 preferably extends out of the upper receiving groove 1121. A lower end of the switch button 113 is provided with a recessed groove 1131.

Still referring to FIG. 4 to FIG. 6, the switch assembly 14 is mounted in the upper receiving groove 1121 and the lower receiving groove 1111 of the insulating base 11. The switch assembly 14 comprises a base body 141, a switch member 142 fixed in the base body 141, an electric contact piece 143 used to control on-off status of the switch member 142, a push rod 144 fixedly connected with the electric contact piece 143 and a spring 145 sheathing the push rod 144.

The base body 141 is made of an insulting material and provided with a stepped through groove 1412 penetrating in the up-down direction therein. The switch member 142, the electric contact piece 143 and the push rod 144 are sequentially mounted in the through groove 1412 from down to up. The switch member 142 is fixed in the through groove 1412, a switch terminal 1421 of the switch member 142 extends downwardly out of the base body 141 for connecting to a circuit board. The electric contact piece 143 and the push rod 144 are movable up and down and provided in the through groove 1412.

An outer circumference of a middle part of the base body 141 is provided with a flange 1411 protruding outwardly, when the base body 141 is mounted in the insulating base 11, the flange 1411 abuts against the step surface at the boundary between the upper receiving groove 1121 and the lower receiving groove 111, thereby facilitating accurate positing of a mounting position of the base body 141 in the insulating base 11. A lower surface of the base body 141 is generally flush with the lower surface of the base portion 111. An upper end of the base body 141 extends into the recessed groove 1131 of the switch button 113. An upper end of the push rod 144 extends upwardly beyond the base body 141 and fixedly connected with the switch button 113.

When the switch button 113 is pressed, the switch button 113 moves downwardly along the upper receiving groove 1121, pushes the push rod 144 and the electric contact piece 143 toward the switch member 142, when the push rod 144 and the electric contact piece 143 are pushed in place, the electric contact piece 143 contacts the switch member 142, thereby the on state or the off state of the switch member 142 can be changed (i.e., achieves the switching function). Also, rebound of the spring 145 makes the switch button 113 move upwardly return to an original position of the switch button 113, so as to accept a next push operation.

As shown in FIG. 4, the first magnetic attraction ring 13 is circular, fixedly sheathes an outer circumference of the mating portion 112, and contacts the upper surface of the base portion 111. A height of the first magnetic attraction ring 13 is smaller than a height of the mating portion 112 to make an upper end of the mating portion 112 extend beyond the first magnetic attraction ring 13.

The first magnetic attraction ring 13 may be a magnet, such as a ferrite magnet or a neodymium iron boron magnet. The first magnetic attraction ring 13 may also be a metal ring made of a ferromagnetic material (such as soft iron, silicon steel, nickel iron alloy and the like). The first magnetic attraction ring 13 is preferably a metal ring made of a ferromagnetic material, is not have magnetic or has a weak magnetic property, so that when the first connector 1 is mounted in the electronic device, the first magnetic attraction ring 13 does not interfere with the magnetic elements of the electronic device, and the performance of the electronic device is guaranteed.

Together referring to FIG. 4 to FIG. 6, the two first conductive members 12 are respectively a first central conductive member 121 and a first lateral conductive member 122.

The first central conductive member 121 comprises a mating end 1211, a connection end 1213 connected with the mating end 1211, and a bridging member 1212 slidably contact the connection end 1213.

The bridging member 1212 is long strip shaped, and can be inserted in the guiding groove 1112 of the insulating base 11 by insert molding process or assembling manner, and engaged with the base portion 111 and the mating portion 112 and fixed. A tail 12122 of the bridging member 1212 further extends downwardly out of the base portion 111 for electrically connecting with the circuit board (not shown in the figure).

The mating end 1211 is a circular shaped piece, is embedded on the switch button 113, and exposed on an upper surface of the switch button 113 for electrically connecting with the second connector 2. An upper surface of the mating end 1211 is flush with the upper surface of the switch button 113. The mating end 1211 has a larger contact area and facilitates reliability of the electrical connection.

The connection end 1213 is long strip shaped, partially embedded on the switch button 113. The connection end 1213 extends downwardly from a side edge of the mating end 1211 and extends beyond the switch button 113. A lower end of the connection end 1213 has a protrusion 1215 protruding outwardly, the protrusion 1215 is arch-shaped and has elasticity, and elastically abuts against the bridging member 1212.

The mating end 1211 and the connection end 1213 of the first central conductive member 121 can be integrated with the switch button 113 by insert molding. As the switch button 113 moves up and down, the protrusion 1215 of the connection end 1213 and the bridging member 1212 can slidably contact up and down to maintain the electrical connection.

The first lateral conductive member 122 comprises a mating end 1221 which is cylindrical and a tail 1222 which is long strip shaped. The mating end 1221 encircles the mating portion 112 and is provided on the mating portion 112, and exposed on the outer circumferential surface of the mating portion 112 for electrically connecting with the second connector 2. The tail 1222 is a soldering leg extending downwardly from the mating end 1221, is connected to a lower end of the mating end 1221, and extends downwardly along a side edge of the mating portion 112; the tail 1222 passes downwardly through the base portion 111 and extends beyond the lower surface of the base portion 111 for connecting with the circuit board.

The first lateral conductive member 122 can also be engaged with the base portion 111 and the mating portion 112 by insert molding process or assembling manner.

An assembling process of the first connector 1 generally is as follows; forming the switch button 113 with the mating end 1211 and the connection end 1213 of the first central conductive member 121 by the insert molding process, forming the base portion 111 and the mating portion 112 with the bridging member 1212 and the first lateral conductive member 122 by the insert molding process; connecting and fixing the switch button 113 and the assembled switch assembly 14, and mounting the switch button 113 and the assembled switch assembly 14 in the base portion 111 and the mating portion 112 from up to down, making the switch button 113 received in the upper receiving groove 1121 and making the connection end 1213 of the first central conductive member 121 extend into the guiding groove 1112 and slidably contact the bridging member 1212.

Figure 7:
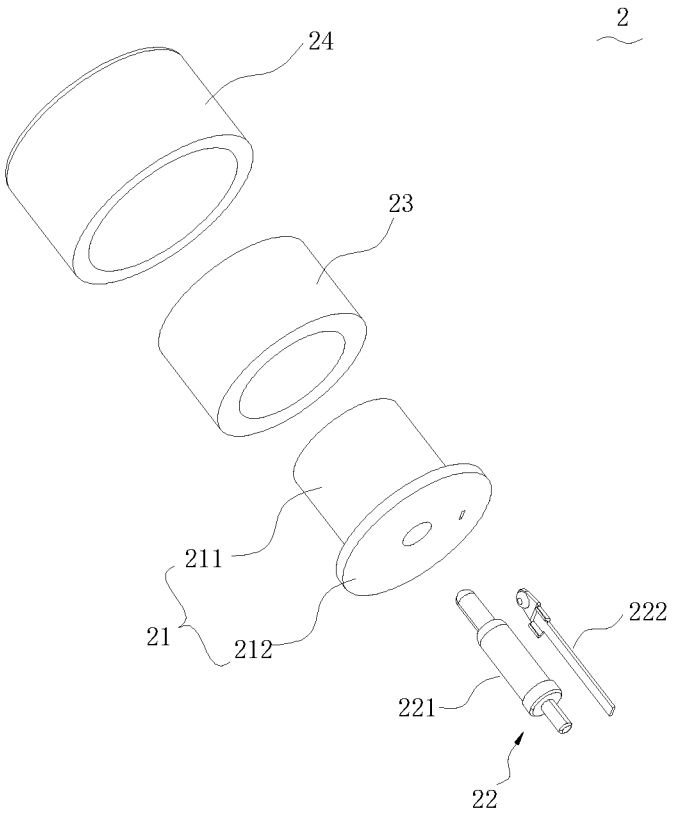
FIG. 7 and FIG. 8 are perspective exploded views of a second connector of FIG. 1 from two different angles.
Figure 8:
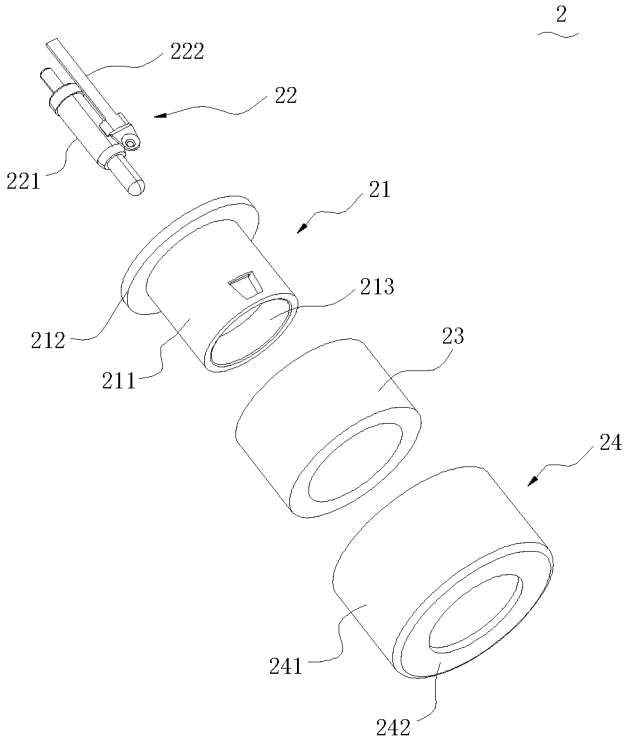
Figure 9:
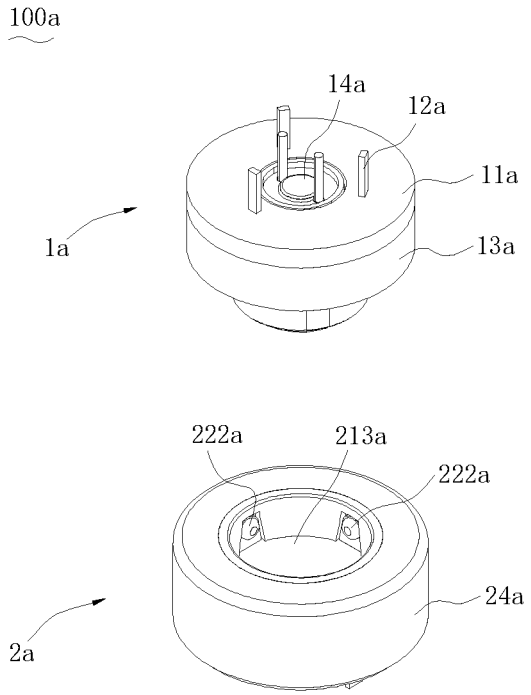
FIG. 9 is a perspective view of a second embodiment of the electrical connector assembly of the present disclosure.

Referring to FIG. 4, FIG. 7 and FIG. 8, the second connector 2 comprises an insulating body 21, two second conductive members 22 fixed to the insulating body 21, a second magnetic attraction ring 23 sheathing an outer circumference of the insulating body 21 and a cover 24 further sheathing an outer circumference of the second magnetic attraction ring 23.

The insulating body 21 is preferably formed with the two second conductive members 22 by insert molding process. The insulating body 21 comprises a base 212 and a protruding portion 211 protruding upwardly from the base 212. The protruding portion 211 and the base 212 are both cylindrical, and a radius of the protruding portion 211 is smaller than a radius of the base 212, so that the insulating body 21 forms a stepped structure. An upper surface of the protruding portion 211 is recessed to form an accommodating groove 213, the accommodating groove 213 is circular, an axis of the accommodating groove 213 coincides with an axis of the protruding portion 211.

The second magnetic attraction ring 23 is circular, fixedly sheathes an outer circumference of the protruding portion 211, and contacts an upper surface of the base 212, an outer circumferential surface of the second magnetic attraction ring 23 is flush with an outer circumferential surface the base 212. A height of the second magnetic attraction ring 23 is slightly smaller than a height of the protruding portion 211, which makes the protruding portion 211 slightly extend beyond the second magnetic attraction ring 23.

The second magnetic attraction ring 23 may be a magnet, such as ferrite magnet or neodymium iron boron magnet. The second magnetic attraction ring 23 may also be a metal ring made of ferromagnetic material (such as soft iron, silicon steel, nickel iron alloy and the like). The second magnetic attraction ring 23 is preferably a magnet.

The cover 24 comprises a circumferential wall 241 which is cylindrical and an end wall 242 which is circular and connected to an upper end of the circumferential wall 241. The circumferential wall 241sheathes an outer circumference of the second magnetic attraction ring 23, and extends downwardly beyond a lower surface of the second magnetic attraction ring 23 to further sheathe an outer circumference of the base 212. The end wall 242 covers an upper surface of the second magnetic attraction ring 23, an upper surface of the end wall 242 is flush with the upper surface of the protruding portion 211.

The two second conductive members 22 respectively are a second central conductive member 221 and a second lateral conductive member 222.

Referring to FIG. 4, the second central conductive member 221 is inserted into and fixed in a center of the insulating body 21. The second central conductive member 221 is preferably a pogo pin (spring probe), and comprises a tip 2212, a sleeve 2213 fixed on the tip 2212, a spring 2214 mounted in the sleeve 2213 and a contact end 2211; the contact end 2211 can elastically move up and down relative to the tip 2212 by the spring 2214. The tip 2212 fixed to the base 212, and protrudes downwardly from a surface of the base 212. The sleeve 2213 is inserted into the insulating body 21. The contact end 2211 extends upwardly out of the sleeve 2213 to protrude upwardly from a bottom of the accommodating groove 213 and be exposed in the accommodating groove 213.

The second lateral conductive member 222 is substantially strip shaped, and fixed in a side edge of the insulating body 21. The second lateral conductive member 222 comprises a contact end 2221 exposed on an inner circumferential wall of the accommodating groove 213 and a tip 2222 extends downwardly beyond the base 212. The contact end 2221 has elasticity and protrudes toward an axis of the insulating body 21 relative to the tip 2222 to make the contact end 2221 slightly protrude from the inner circumferential wall of the accommodating groove 213.

Combined with FIG. 1 to FIG. 4, when the first connector 1 and the second connector 2 are mated with each other, the first connector 1 is preferably used as a charging connector. The mating portion 112 of the first connector 1 is inserted into the accommodating groove 213 of the second connector 2, the mating end 1221 of the first lateral conductive member 122 is electrically connected with the contact end 2221 of the second lateral conductive member 222, the mating end 1211 of the first central conductive member 121 is electrically connected with the contact end 2211 of the second central conductive member 221, so that the second connector 2 can provide power for the first connector 1, thereby in turn charging the electronic device equipped with the first connector 1. Because the mating end 1221 of the first lateral conductive member 122 circles and is exposed on the outer circumference of the mating portion 112, the mating portion 112 can maintain electrical connection between the mating end 1221 and the contact end 2221 regardless of any rotation of the mating portion 112 in the accommodating groove 213, thereby achieving function of 360 degree mating and charging. The first magnetic attraction ring 13 of the first connector 1 and the second magnetic attraction ring 23 of the second connector 2 are magnetically attracted together to maintain the electrical connection between the first conductive member 12 and the second conductive member 22.

When the first connector 1 is not connected with the second connector 2, the first connector 1 is used as a switch connector, the switch button 113 can accept the user's press to control the on state or the off state of the switch member 142 to realize the switch function.

Referring to FIG. 9 to FIG. 12, as in the first embodiment, an electrical connector assembly 100*a* of the present embodiment also comprises a first connector 1*a* and a second connector 2*a* which are matched with each other. The first connector 1*a* integrates switch function and charging function.

Figure 12:
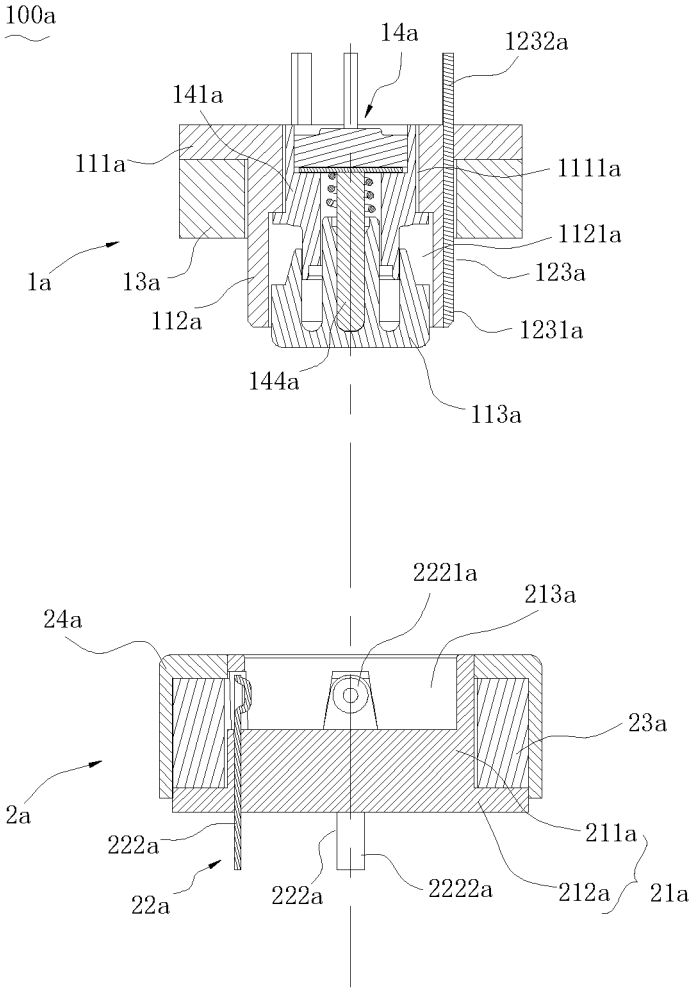
FIG. 12 is a cross sectional view along a line B-B of FIG. 11.
Figure 13:
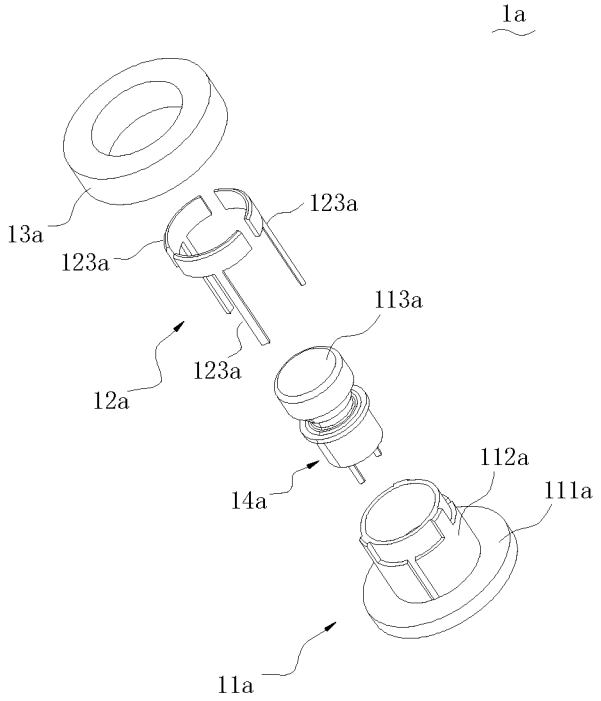
FIG. 13 and FIG. 14 are perspective exploded views of first connector of FIG. 9 from two different angles.
Figure 14:
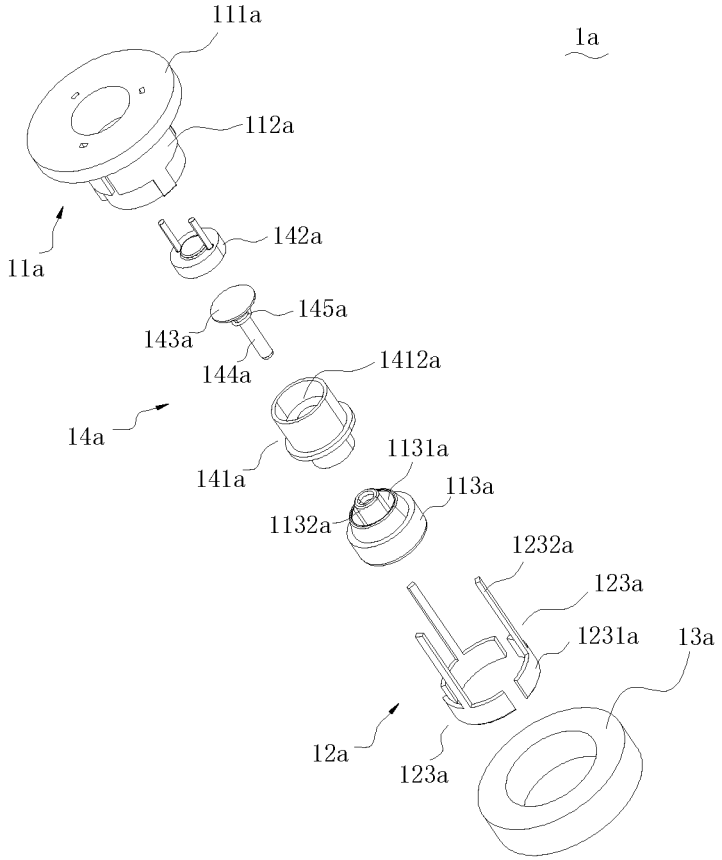

Referring to FIG. 12 to FIG. 14, a structure of the first connector 1*a* is substantially the same as that of the first connector 1 of the first embodiment, the first connector 1*a* also comprises an insulating base 11*a*, a plurality of first conductive members 12*a* fixed to the insulating base 11*a*, a first magnetic attraction ring 13*a* sheathing the insulating base 11*a* and a switch assembly 14*a* fixed in the insulating base 11*a*.

As in the first embodiment, the insulating base 11*a* comprises a base portion 111*a*, a mating section 112*a* protruding upwardly from portion base 111*a* and a switch button 113*a* which can move up and down. The switch button 113*a* can move up and down along the upper receiving groove 1121*a* of the mating portion 112*a*. The switch assembly 14*a* comprises a base body 141*a*, a switch member 142*a* fixed in the base body 141*a*, an electric contact piece 143*a* used to control on-off status of the switch member 142*a*, a push rod 144*a* fixedly connected with the electric contact piece 143*a* and a spring 145*a* sheathing the push rod 144*a*. The switch assembly 14*a* is mounted in the upper receiving groove 1121*a* and the lower receiving groove 1111*a* of insulating base 11*a*, realizes the switch function by the up and down movement of the switch button 113. The first magnetic attraction ring 13*a* sheathes the mating portion 112*a*.

Difference from the first embodiment lies in that; in the present embodiment, the number of the first conductive members 12*a* is three, and the first conductive members 12*a* all are the third lateral conductive members 123*a* and do not comprise the first central conductive member 121.

Figure 10:
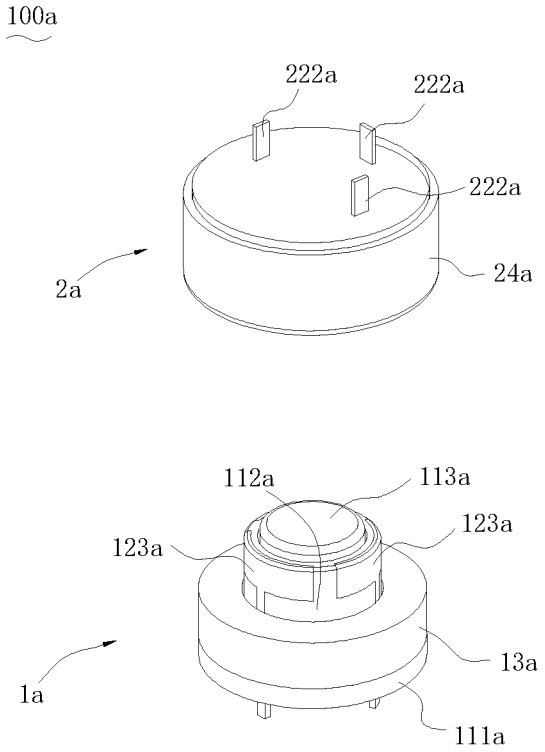
FIG. 10 is a perspective view of FIG.9 from another angle.
Figure 11:
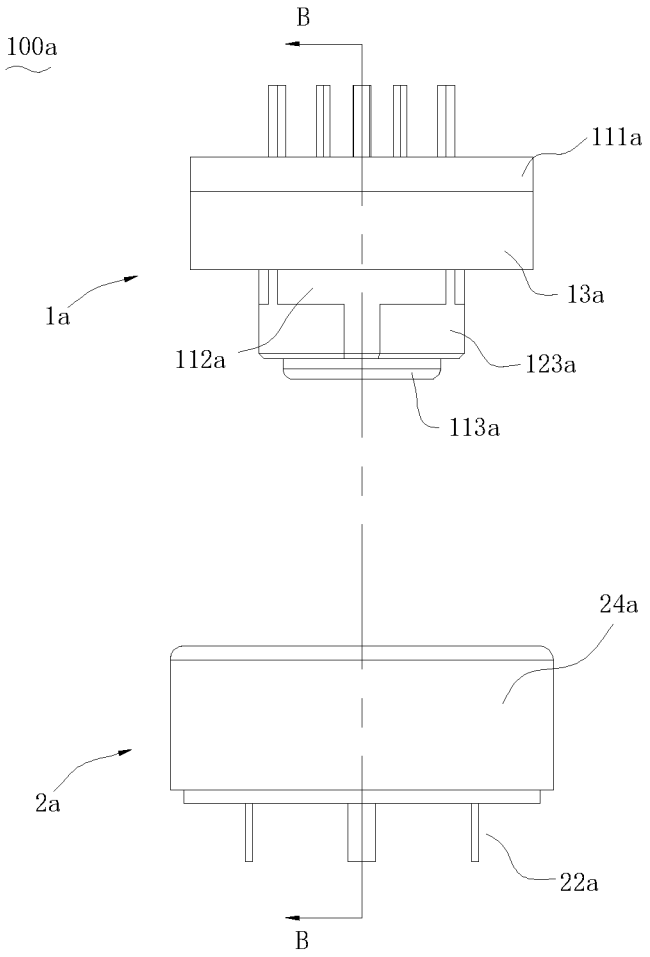
FIG. 11 is a front view of FIG. 9.

The third lateral conductive member 123*a* comprises a mating end 1231*a* which is circular arc shaped and a tail 1232*a* which is long strip shaped. Referring to FIG. 10, the three third lateral conductive members 123 are uniformly distributed along an outer circumference of the mating portion 112*a*, the mating ends 1231*a* of the three third lateral conductive member 123*a* are all exposed on the outer circumference of the mating portion 112*a*, and are flush with the outer circumferential surface of the mating portion 112*a*, each mating end 1231*a* occupies approximately 120 degrees of arc surface of the mating portion 112*a*. The mating ends 1231*a* of the two adjacent third lateral conductive member 123*a* have a slight gap therebetween. Referring to FIG. 12, the tail 1232*a* extends downwardly from the mating end 1231*a* along a side edge of the mating portion 112*a*, passes through the base portion 111*a* and extends out downwardly.

In the first connector 1*a*, it no longer needs to embed the central conductive member on the switch button 113*a* as in the first embodiment. Referring to FIG. 12 and FIG. 14, a cooperating portion 1132*a*, which is cylindrical, is provided in the recessed groove 1131*a* of the switch button 113*a*, the cooperating portion 1132*a*allows the push rod 144*a* of the switch assembly 14*a* to extend into the cooperating portion 1132*a*, at the same time, the cooperating portion 1132*a* extends into the through groove 1412*a* of the base body 141*a* of the switch assembly 14*a* , which makes the up and down movement of the switch button 113*a* more stable.

Figure 15:
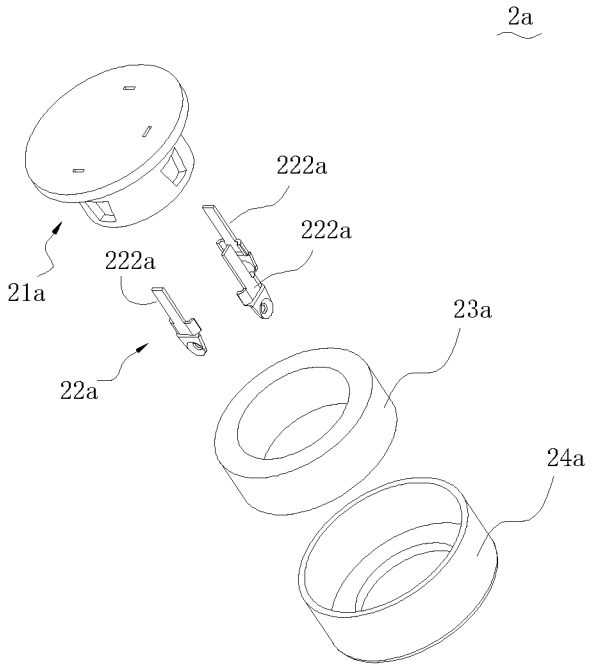
FIG. 15 and FIG. 16 are perspective exploded views of second connector of FIG. 9 from two different angles.
Figure 16:
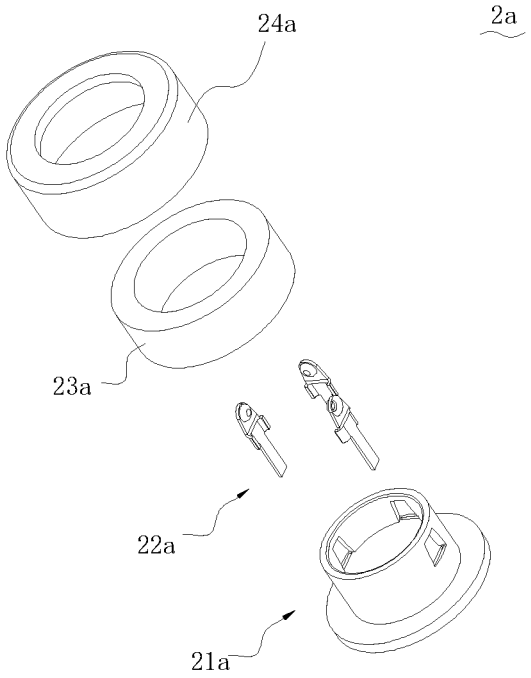

Referring to FIG. 12, FIG. 15 and FIG. 16, in the present embodiment, the structure of the second connector 2*a* is substantially the same as that of the second connector 2 in the first embodiment, the second connector 2*a* comprises an insulating body 21*a*, a plurality of conductive members 22*a* fixed in the insulating body 21*a*, a second magnetic attraction ring 23*a* sheathing the outer circumference of the insulating body 21*a*, a cover 24*a* further sheathing the outer circumference of the second magnetic attraction ring 23*a*. The upper surface of the insulating body 21*a* is recessed downwardly to form an accommodating groove 213*a*.

Difference from the first embodiment lies in that, in the present embodiment, the number of the second conductive members 12*a* is three, and the second conductive members 12*a* all are the second lateral conductive member 123*a* and does not comprise the second central conductive member 221.

The structure of the second lateral conductive member 222*a* is substantially the same as that of the second lateral conductive member 222 in the first embodiment. Referring to FIG. 10 and FIG. 12, the three second lateral conductive members 222*a* are fixed to the side edge of the insulating body 21*a*, and distributed in isosceles right triangle. The contact ends 2221*a* of the three second lateral conductive members 222*a* are respectively exposed on the inner wall of the accommodating groove 213*a* of the insulating body 21*a*, the tips 2222*a* of the three second lateral conductive members 222*a* extends downwardly along the side edge of the protruding portion 211*a* of the insulating body 21*a* and extends beyond the base 212*a* of the insulating body 21*a*. In the circumferential direction along the inner wall of the accommodating groove 213*a*, a circumferential angle between the two contact ends 2221*a* corresponding to the triangular waist sides is 90 degrees, and a circumferential angle between the two contact ends 2221*a* corresponding to the bottom edge of the triangle is 180 degrees. A width of each the contact end 2221*a* is smaller than an interval between the mating ends 1231*a* of the two adjacent third lateral conductive members 123*a* of the first connector 1*a*.

When the first connector 1*a* and the second connector 2*a* of the present embodiment are mated with each other, the mating portion 112*a* of the first connector 1*a* is inserted into the accommodating groove 213*a* of the second connector 2*a*. The first connector 1*a* can assure that the corresponding contact between the mating ends 1231*a* of two of the three third lateral conductive members 123*a* and the contact ends 2221*a* of two of the three second lateral conductive members 222*a* of the second connector 2*a* regardless of that the first connector 1*a* is positioned at any angle in the accommodating groove 213*a*, so that the charging can be carried out by that a circuit controls a chip, and a function of 360 degree mating and charging is achieved. When the first connector 1 is not connected with the second connector 2, the first connector 1 may also be used as a switch connector.

According to the above-mentioned embodiments, in the present disclosure, both the first connector 1/1*a* and the second connector 2/2*a* can achieve a function of 360 degree mating and charging, have a blind mating function, which is convenient for a user to use. The first connector 1/1*a* mounts a switch assembly 14/14*a* in the insulating base 11/11*a*, and at the same time is equipped with a first conductive member 12/12*a*, so the switch function and the charging function are integrated at the same time on the first connector 1/1*a*. Two functions are integrated on one connector at the same time, when applied to a small electronic device, the connector can be used as a switch connector or a charging connector according to actual application situation, which can save one connector, save application space and cost in the small electronic device, facilitates miniaturization of the electronic device. When the first connector is used as a charging connector, the first connector and the second connector keep a reliable connection by magnetic attraction.

The above described contents are only the preferred embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

What is claimed is:

1. A first connector, comprising:

an insulating base comprising a base portion and a mating portion protruding upwardly from the base portion, the mating portion having a receiving groove and a switch button which can move up and down along the receiving groove;

a switch assembly provided in the insulating base and achieving switch function by up and down movement of the switch button;

a first magnetic attraction ring sheathing an outer circumference of the mating portion, the mating portion extending upwardly beyond the first magnetic attraction ring;

a plurality of first conductive members fixed on the insulating base, each first conductive member having a mating end and a tail, wherein the mating end of at least one first conductive member is exposed on an outer circumferential surface of the mating portion, and the tail extends downwardly out of the base portion.

2. The first connector according to claim 1, wherein the plurality of first conductive members comprising a first central conductive member and a first lateral conductive member, the mating end of the first central conductive member is exposed on an upper surface of the switch button, the mating end of the first lateral conductive member encircles and is exposed on the outer circumferential surface of the mating portion.

3. The first connector according to claim 2, wherein the first central conductive member further comprises a connection end extending from the mating end and a bridging member movably contacting the connection end, a tail of the bridging member extends downwardly out of the base portion.

4. The first connector according to claim 3, wherein the connection end has a protrusion which can be elastically deformed, the protrusion and the bridging member movably contact each other.

5. The first connector according to claim 1, wherein the plurality of first conductive members comprising three third lateral conductive members, the mating ends of the three third lateral conductive members are circular arc-shaped and arranged at uniform intervals on the outer circumference of the mating portion.

6. The first connector according to claim 5, wherein the tail of the third lateral conductive member is a soldering leg extending downwardly from the mating end.

7. A second connector, comprising:

an insulating body comprising a base and a protruding portion protruding upwardly from the base, an upper surface of the protruding portion being recessed with an accommodating groove;

a second magnetic attraction ring sheathing an outer circumference of the protruding portion;

a plurality of second conductive members fixed in the insulating body, each second conductive member comprising a contact end and a tip, the contact end being exposed in the accommodating groove, the tip protruding downwardly from the base;

a cover sheathing outer circumferences of the insulating body and the second magnetic attraction ring.

8. The second connector according to claim 7, wherein the plurality of second conductive members comprise a second central conductive member and a second lateral conductive member, the contact end of the second central conductive member protrudes upwardly from a bottom of the accommodating groove, the contact end of the second lateral conductive member is exposed on an inner circumferential wall of the accommodating groove.

9. The second connector according to claim 7, wherein the plurality of second conductive members comprise three second lateral conductive members, the contact ends of the three second lateral conductive members are arranged in an isosceles right triangle and exposed to the inner circumferential wall of the accommodating groove.

10. An electrical connector assembly, comprising:

a first connector comprising:

an insulating base comprising a base portion and a mating portion protruding upwardly from the base portion, the mating portion having a receiving groove and a switch button which can move up and down along the receiving groove;

a switch assembly provided in the insulating base and achieving switch function by up and down movement of the switch button;

a first magnetic attraction ring sheathing an outer circumference of the mating portion, the mating portion extending upwardly beyond the first magnetic attraction ring; and a plurality of first conductive members fixed on the insulating base, each first conductive member having a mating end and a tail, wherein the mating end of at least one first conductive member is exposed on an outer circumferential surface of the mating portion, and the tail extends downwardly out of the base portion; and a second connector comprising:

an insulating body comprising a base and a protruding portion protruding upwardly from the base, an upper surface of the protruding portion being recessed with an accommodating groove;

a second magnetic attraction ring sheathing an outer circumference of the protruding portion;

a plurality of second conductive members fixed in the insulating body, each second conductive member comprising a contact end and a tip, the contact end being exposed in the accommodating groove, the tip protruding downwardly from the base; and a cover sheathing outer circumferences of the insulating body and the second magnetic attraction ring, wherein the mating portion of the first connector is correspondingly inserted into the accommodating groove of the second connector, the first magnetic attraction ring and the second magnetic attraction ring are magnetically attracted together to maintain electrical connection between the first conductive member and the second conductive member.

* * * * *